United States Patent [19]

Mills

[11] Patent Number: 4,813,727

[45] Date of Patent: Mar. 21, 1989

[54] MOTOR VEHICLE ANTI-THEFT DOOR LATCH CONTROL BUTTON

[76] Inventor: Roy I. Mills, 915 Pensacola Way SE., Calgary, Alberta T2A 2G8, Canada

[21] Appl. No.: 111,754

[22] Filed: Oct. 22, 1987

[30] Foreign Application Priority Data

Nov. 19, 1986 [CA] Canada ..... 523343

[51] Int. Cl.[4] ..... E05C 21/00

[52] U.S. Cl. ..... 292/347; 292/336.3

[58] Field of Search ..... 292/1, 336.3, 347

[56] References Cited

U.S. PATENT DOCUMENTS 2,512,440 6/1950 Rook ..... 292/347 X
2,853,332 9/1958 Skutnik ..... 292/347
4,098,529 7/1978 Bingham ..... 292/347 X
4,239,270 12/1980 Bridges ..... 292/347

*Primary Examiner*—Richard E. Moore
*Attorney, Agent, or Firm*—Harold H. Dutton, Jr.

[57] ABSTRACT

The conventional anti-theft door latch control button for use on a motor vehicle door includes a cylindrical, relatively thick-walled body with a closed top end and an open bottom end. A better design includes a tubular body with an open bottom end for mounting the button on a latch control pin, a closed, upwardly tapering upper end, and a downwardly tapering bottom portion for limiting access to the bottom end, whereby the bottom end cannot readily be hooked to pull the button upwardly to the open position.

2 Claims, 3 Drawing Sheets

MOTOR VEHICLE ANTI-THEFT DOOR LATCH CONTROL BUTTON

This invention relates to an anti-theft door lock control device, and in particular to an anti-theft door latch control button for use on motor vehicle doors.

The conventional control button for use on the latch control pin of a vehicle door lock includes a cylindrical body with an enlarged head facilitating manual gripping of the button for locking or unlocking the vehicle door. A problem inherent with such a latch control button is that the button is relatively easy to lift from outside the vehicle using a coat hanger or other object. Thus, theft of a motor vehicle may be a relatively simple.matter In an attempt to solve this problem, cylindrical latch control buttons have been made available to the public. However, the cylindrical buttons have a relatively thick, tubular bottom end which can be engaged by inserting a hook beneath the door sill, i.e. by sliding a hook into the top edge of the door adjacent to the latch control button.

The object of the present invention is to provide a relatively simple, streamlined anti-theft door latch control button which solves the problems identified above, and reduces the likelihood of vehicle theft.

Accordingly, the present invention relates to a vehicle anti-theft door latch control button comprising elongated tubular body means with an open bottom end for mounting the button on a vehicle latch control pin, and a closed top end; said body means including a downwardly tapering lower end portion, whereby the bottom end of the body means defines a thin annulus with tapering sides which limit access to such bottom end from above.

The invention will now be described in greater detail with reference to the accompanying drawings, which illustrate preferred embodiments of the invention, and wherein.

Figure 1:
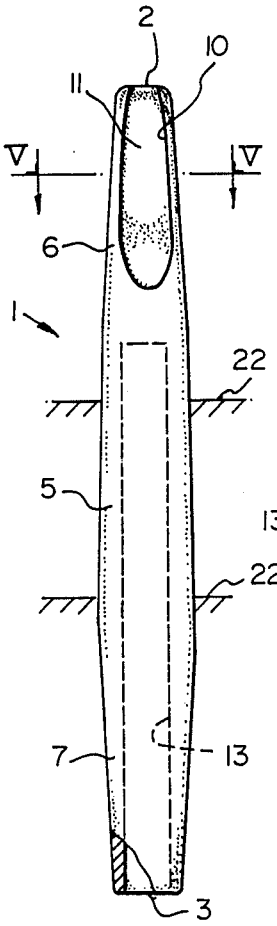
FIG. 1 is a partly sectioned, front elevation view of one embodiment of door latch control button in accordance with the present invention.
Figure 2:
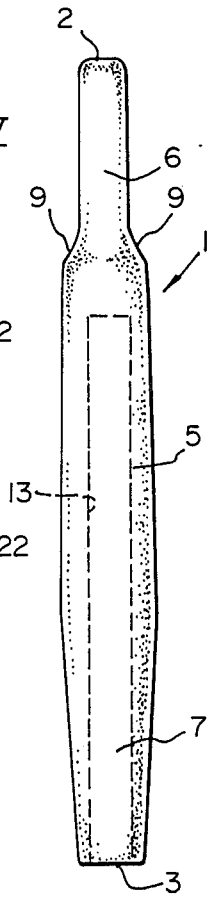
FIG. 2 is a side elevation view of the latch control button of FIG. 1.
Figure 3:
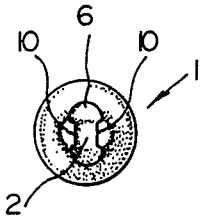
FIG. 3 is a plan view of the latch control button of FIGS. 1 and 2.
Figure 4:
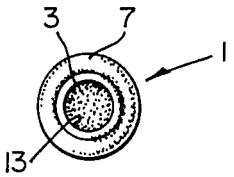
FIG. 4 is a bottom view of the latch control button of FIGS. 1 to 3.
Figure 5:
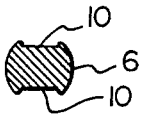
FIG. 5 is a cross section taken generally along line V—V of FIG. 1.
Figure 6:
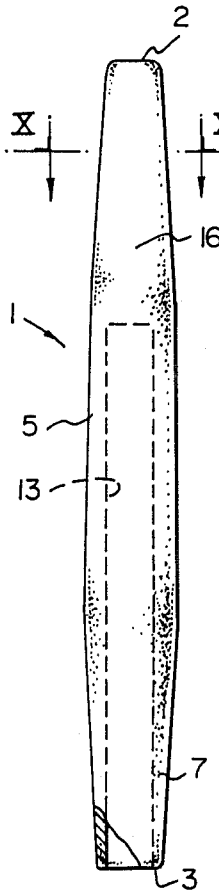
FIG. 6 is a partly sectioned, front elevation view of a second embodiment of latch control button in accordance with the present invention.
Figure 7:
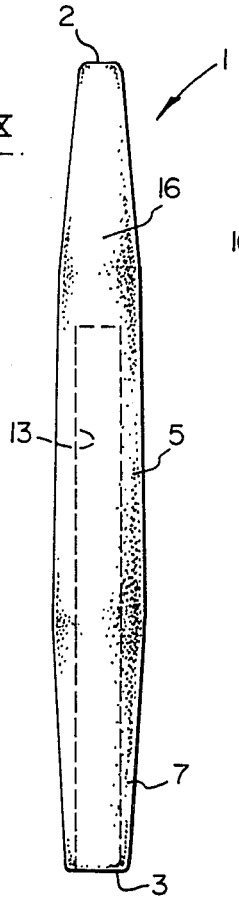
FIG. 7 is a side elevation view of the latch control button of FIG. 6.

With reference to FIGS. 1 to 5 of the drawings, one embodiment of the latch control button in accordance with the invention includes an elongated tubular body generally indicated at 1 with a closed top end 2 and an open bottom end 3. The body 1 is defined by a slightly upwardly tapering central portion 5, an upwardly tapering top portion 6 which tapers more than the central portion 5, and a downwardly tapering bottom portion 7. Shoulders 9 are provided on the front and rear surfaces of the body 1 at the junction between the central portion 5 and the upper portion 6. Elongated, generally drop-shaped grooves 10 are provided in the front and rear surfaces of the upper portion 6 of the body 1 for facilitating gripping of such body 1 by the vehicle user. The flat bottom surfaces 11 of the grooves 10 are textured or roughened The opening or recess 13 in the body 1 extends from the bottom end 3 to the vicinity of the juncture between the central and top portions 5 and 6, respectively of the body. The bottom end of the cylindrical opening 13 is smooth and unthreaded to facilitate the placing of the button on the normally threaded latch operating pin (not shown) Approximately the upper twothirds of the recess 13 is threaded for attaching the button to the latch operating pin.

Figure 8:
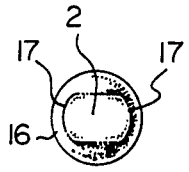
FIG. 8 is a plan view of the latch control button of FIGS. 6 and 7.
Figure 9:
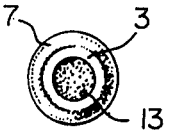
FIG. 9 is a bottom view of the latch control button of FIGS. 6 to 8.
Figure 10:
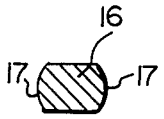
FIG. 10 is a cross section taken generally along line X—X of FIG. 6.
Figure 11:
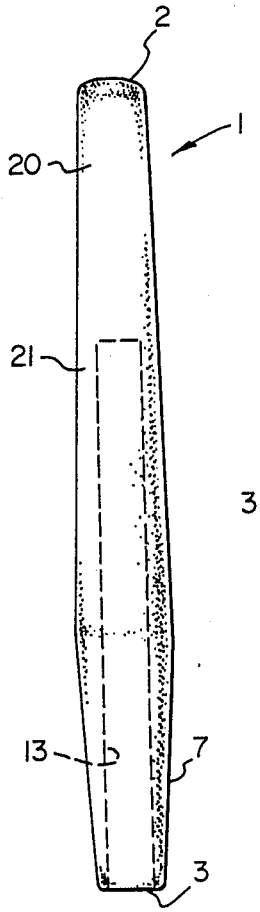
FIG. 11 is a front elevation view of a third embodiment of latch control button in accordance with the present invention.
Figure 12:
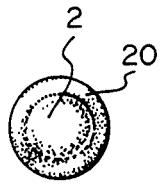
FIG. 12 is a plan view of the latch control button of FIG. 11.
Figure 13:
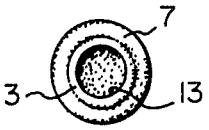
FIG. 13 is a bottom view of the latch control button of FIGS. 11 and 12.

Referring to FIGS. 6 to 10, a second embodiment of the invention will be described. Wherever possible the same referenc numerals are used in FIGS. 6 to 13 to identify elements the same or similar to those of FIGS. 1 to 5. The second embodiment of button is structurally similar to the first embodiment, except that the shoulders 9 are omitted, and the upper portion 16 of the body 1 is smooth and tapering when viewed from any side Such upper portion 16 of the body 1 is generally rectangular in cross section, with rounded ends 17 (FIGS. 8 and 10).

The third embodiment of the invention (FIGS. 11 to 13) includes a tubular body 1 with a downwardly tapering bottom portion 7, an upwardly tapering top portion 20 and an upwardly tapering central portion 21. The taper of the top portion 20 is the same as that of the central portion 21, so that the two portions define an elongated, upwardly tapering section, contiguous with the bottom portion 7.

In use, the body 1 is mounted on a latch control pin so that the upper and central portions of the body 1 are located above the top edge 22 (FIG. 1) of the door in the unlocked position of the door lock. When the button is pressed to the closed position, only the upper portion and part of the central portion of the body 1 are above such top edge 22 of the door, i.e. above the sill of the window.

The embodiments of an invention in which an exclusive property or privilege is claimed are defined as follows:

1. An anti-theft door latch control button comprising an elongated tubular body having a longitudinal bore therein open at the bottom of said body and closed at the top, said body having a downwardly and inwardly tapering lower portion, and an upwardly and inwardly tapering upper portion, the bottom portion of said bore being a smooth wall unthreaded portion and the upper portion of said bore having threads formed therein for threadedly engaging a lock operating member, whereby the bottom end of said body forms a thin annulus for limiting access to the bottom end from above.

2. An anti-theft door latch control button as in claim 1 and wherein said body has a cylindrical central portion between said upper and lower portions.

* * * * *